US007010413B2

(12) United States Patent
Dudek et al.

(10) Patent No.: US 7,010,413 B2
(45) Date of Patent: Mar. 7, 2006

(54) CYLINDER MASS AIR FLOW PREDICTION MODEL

(75) Inventors: Kenneth P. Dudek, Rochester Hills, MI (US); Layne K. Wiggins, Plymouth, MI (US)

(73) Assignee: General Motors Corporation, Detroit, MI (US)

( * ) Notice: Subject to any disclaimer, the term of this patent is extended or adjusted under 35 U.S.C. 154(b) by 166 days.

(21) Appl. No.: 10/664,290

(22) Filed: Sep. 17, 2003

(65) Prior Publication Data

US 2005/0060084 A1 Mar. 17, 2005

(51) Int. Cl.
*G06G 7/70* (2006.01)

(52) U.S. Cl. ..... 701/102; 701/103; 701/104; 123/436; 123/492; 123/493; 73/117.2; 73/117.3; 73/118.2

(58) Field of Classification Search ..... 701/102, 701/103, 104; 123/436, 492, 493; 73/117.2, 73/117.3, 118.2
See application file for complete search history.

(56) References Cited

U.S. PATENT DOCUMENTS

| | | | | |
|---|---|---|---|---|
| 5,270,935 | A | 12/1993 | Dudek et al. | 364/431.01 |
| 5,293,553 | A | 3/1994 | Dudek et al. | 364/431.04 |
| 5,394,331 | A | 2/1995 | Dudek et al. | 364/431.05 |
| 5,423,208 | A | 6/1995 | Dudek et al. | 73/117.3 |
| 5,465,617 | A | 11/1995 | Dudek et al. | 73/118.2 |
| 6,748,313 | B1 * | 6/2004 | Li et al. | 701/102 |

* cited by examiner

*Primary Examiner*—Tony M. Argenbright
*Assistant Examiner*—Johnny H. Hoang
(74) *Attorney, Agent, or Firm*—Christopher DeVries

(57) ABSTRACT

A vehicle system includes a throttle position sensor that generates a current throttle position signal (TPS), a MAF sensor that generates a current actual MAF signal, and a manifold absolute pressure (MAP) sensor that generates a current actual MAP signal. A controller determines a current estimated cylinder air flow (CAF) signal, determines a MAF transient signal and determines a MAP transient signal. The controller determines a predicted CAF signal into the engine based on the current estimated CAF signal, the current actual MAF signal, the current MAP signal, a current TPS signal, the MAF transient signal and the MAP transient signal.

37 Claims, 2 Drawing Sheets

CYLINDER MASS AIR FLOW PREDICTION MODEL

FIELD OF THE INVENTION

The present invention relates to mass air flow into an engine, and more particularly to an engine control system for estimating current mass air flow and for predicting future mass air flow into cylinders of an engine.

BACKGROUND OF THE INVENTION

The air to fuel (A/F) ratio in a combustion engine affects both engine emissions and performance. With current emissions standards for automobiles, it is necessary to accurately control the A/F ratio of the engine. Accurate control requires precise measurement and/or estimation of the mass air flow into the engine.

Traditionally, engine air flow is measured with a mass air flow (MAF) sensor or calculated using a speed-density method. While MAF sensors are more accurate than speed-density calculation systems, they are also more expensive. An estimation-prediction method dynamically determines air flow into the engine using a mathematical model. While this method enables more precise A/F ratio control than traditional methods, inaccuracies may occur as a result of calibration difficulties.

SUMMARY OF THE INVENTION

Accordingly, the present invention provides a vehicle system to predict mass air flow into cylinders of an engine ($CAF_P$). The vehicle system includes a throttle position sensor that generates a current throttle position signal (TPS), a mass air flow (MAF) sensor that generates a current actual MAF into the engine signal, and a manifold air pressure (MAP) sensor that generates a current actual MAP signal. A controller determines a current estimated mass air flow into cylinders signal ($CAF_E$), determines a MAF transient signal, and determines a MAP transient signal. The controller determines a $CAF_P$ signal based on the current $CAF_E$ signal, the current actual MAF signal, the current MAP signal, the current TPS signal, the MAF transient signal, and the MAP transient signal.

In one feature, the MAF transient signal is based on a predefined MAF gain limit and the MAP transient signal is based on a predefined MAP gain limit.

In another feature, the MAF transient signal is based on the current actual MAF signal and a prior actual MAF signal. The controller sets the MAF transient signal to zero if the MAF gain limit is greater than a difference between the current actual MAF signal and the prior actual MAF signal. If the MAF gain limit is less than a difference between the current actual MAF signal and the prior actual MAF signal, then the MAF transient signal is based on a difference between the current actual MAF signal, the prior actual MAF signal, and the MAF gain limit.

In still another feature, the MAP transient signal is based on the current actual MAP signal and a prior actual MAP signal. The controller sets the MAP transient signal to zero if the MAP gain limit is greater than a difference between the current actual MAP signal and the prior actual MAP signal. If the MAP gain limit is less than a difference between the current actual MAP signal and the prior actual MAP signal, then the MAP transient signal is based on a difference between the current actual MAP signal, the prior actual MAP signal, and the MAP gain limit.

In yet another feature, the controller schedules a select set of model coefficients based on a measured engine parameter. The controller determines the $CAF_P$ signal based on the select set of model coefficients. The select set of model coefficients is based on engine speed and MAP.

In still another feature, the controller determines the current $CAF_E$ signal based on a prior $CAF_P$ signal.

Further areas of applicability of the current invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The current invention will become more fully understood from the detailed description and the accompanying drawings, wherein.

DETAILED DESCRIPTION OF THE PREFERRED EMBODIMENTS

Figure 1:
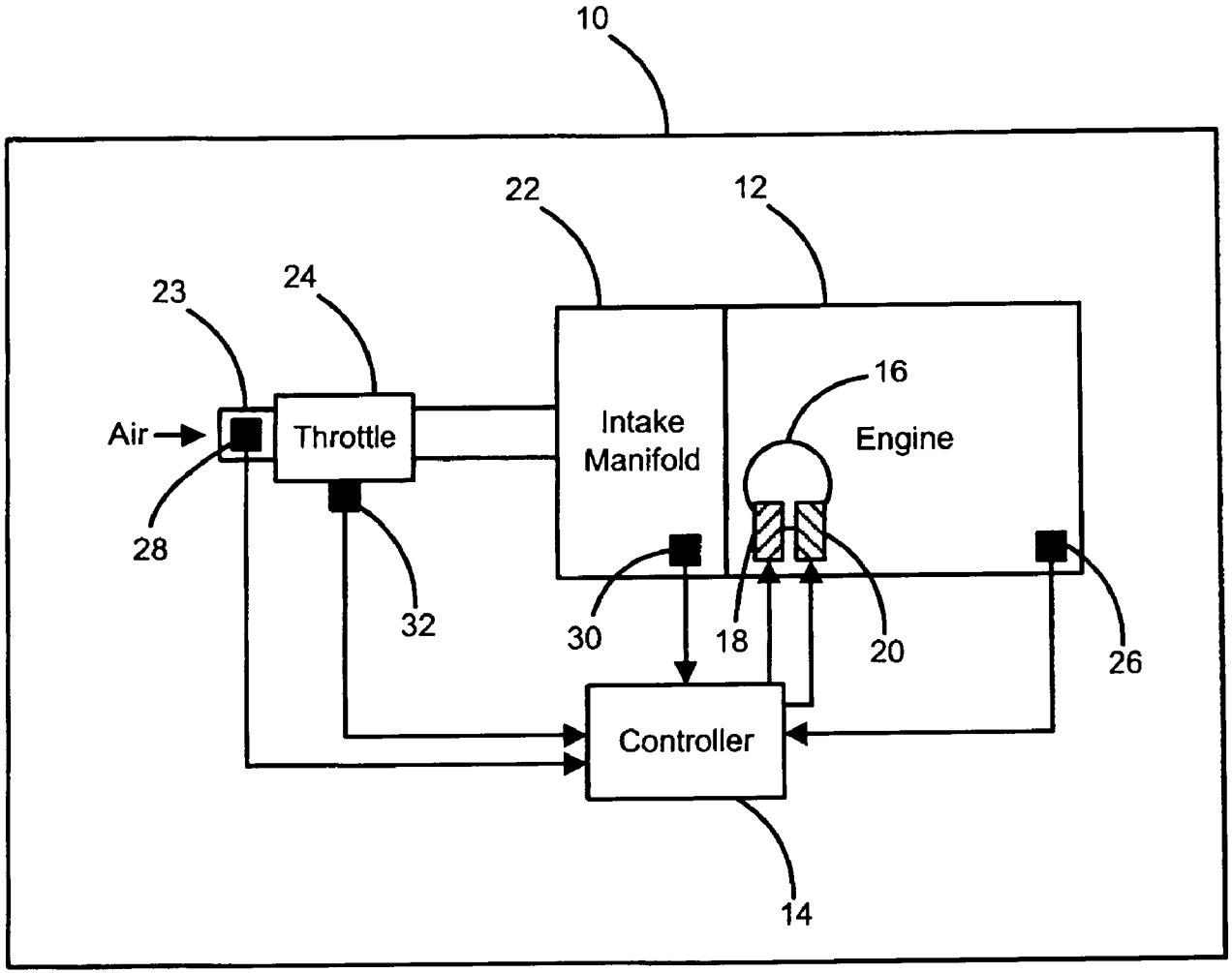
FIG. 1 is a functional block diagram of a vehicle including a controller that estimates current mass air flow and that predicts mass air flow ($CAF_P$) into engine cylinders.

The following description of the preferred embodiment is merely exemplary in nature and is in no way intended to limit the invention, its application, or uses. For purposes of clarity, the same reference numbers will be used in the drawings to identify similar elements.

Referring now to FIG. 1, a vehicle 10 is shown and includes an engine 12 and a controller 14. The engine 12 includes a cylinder 16 having a fuel injector 18 and a spark plug 20. Although a single cylinder 16 is shown, it will be appreciated that the engine 12 typically includes multiple cylinders 16 with associated fuel injectors 18 and spark plugs 20. For example, the engine 12 may include 4, 5, 6, 8, 10, or 12 cylinders 16.

Air is drawn into an intake manifold 22 of the engine 12 through an inlet 23. A throttle 24 regulates the air flow through the inlet 23. Fuel and air are combined in the cylinder 16 and are ignited by the spark plug 20. The throttle 24 is actuated to control air flowing into the intake manifold 22. The controller 14 adjusts the flow of fuel through the fuel injector 18 based on the air flowing into the cylinder 16 to control the A/F ratio within the cylinder 16.

The controller 14 communicates with an engine speed sensor 26, which generates an engine speed signal. The controller 14 also communicates with mass air flow (MAF) and manifold absolute pressure (MAP) sensors 28 and 30, which generate MAF and MAP signals respectively. The controller 14 communicates with a throttle position sensor (TPS) 32, which generates a TPS signal.

The controller 14 estimates current cylinder air flow ($CAF_E$) and predicts future cylinder air flow ($CAF_P$). Similar estimation-prediction systems are disclosed in commonly assigned U.S. Pat. Nos. 5,270,935, issued Dec. 14, 1993, and 5,394,331, issued Feb. 28, 1995, which are incorporated herein by reference. The control system according to the present invention estimates cylinder air flow ($CAF_E$) into each cylinder. The controller 14 commands the fuel injector 18 for each cylinder based on $CAF_P$ to provide a desired A/F ratio within the cylinder 16. The controller 14 also may control ignition timing of the spark plug 20 based on the $CAF_E$.

The estimation-prediction system determines the $CAF_E$ based on prior predicted CAF's ($CAF_P$) and a current measured CAF ($CAF_M$). $CAF_M$ is preferably synthesized from other physical measurements such as MAP, MAF, TPS and RPM. It is anticipated, however, that a physical CAF sensor can be implemented to actually measure the current CAF. Calculation of $CAF_E$ is described in detail in U.S. Pat. Nos. 5,270,935 and 5,349,331.

Estimator correction coefficients are used in a weighted comparison. The estimator correction coefficients are pre-programmed into memory and are predetermined in a test vehicle through a statistical optimization process such as Kalman filtering. The estimator correction coefficients are scheduled based on at least one engine parameter. Statistical optimization of the estimator correction coefficients provides that for a given engine operating point the estimator correction coefficients eventually achieve a steady state. As a result, the estimator correction coefficients may be determined off-line (e.g. in a test vehicle) and pre-programmed into memory.

In accordance with the present invention, $CAF_P$ is determined based on the estimates, current engine parameters, a set of predictor coefficients, and transient behavior. Exemplary engine parameters include TPS, MAP, MAF, and engine speed (RPM). According to the present invention, the predicted $CAF_P$ is calculated as follows:

$$CAF_P(k+1) = a_1 CAF_E(k) + a_2 MAF(k) + a_3 MAF(k-1) + b_1 MAP(k) + {}_2MAP(k-1) + b_3 MAP(k-2) + c_1 TPS(k) + c_2 TPS(k-1) + c_3 TPS(k-2) + d_1 UMAF(k) + d_2 UMAP(k)$$

where k is the current time event, the component UMAF accounts for large MAF transients, and the component UMAP accounts for large MAP transients. To ensure steady-state accuracy, the predictor coefficients are constrained according to the following equations:

$$a_1+a_2+a_3=1$$

$$b_1+b_2+b_3=0$$

$$c_1+c_2+c_3=0$$

The predictor coefficients $d_1$ and $d_2$ are not constrained. The predictor coefficients are scheduled based on at least one engine parameter. For example, the controller 14 looks up the predictor coefficients within a particular schedule zone defined by RPM and MAP at time k. The predictor coefficients are difficult to calibrate in scheduled zones that feature a mix of small and large transients at steady-state.

To alleviate the difficulty of calibrating the predictor coefficients within the schedule zones, the components UMAF and UMAP are used. The component UMAF is governed by the following equations:

$$UMAF(k)=MAF(k)-MAF(k-1)-MAFDEL$$

$$\text{if } MAF(k)>MAF(k-1)+MAFDEL, \text{ otherwise}$$

$$UMAF(k)=0$$

where MAFDEL is a predetermined constant (gain limit) that differentiates between small and large transient behavior in MAF. If there is small transient behavior in MAF, then UMAF is set to zero. The component UMAP is governed by the following equations:

$$UMAP(k)=MAP(k)-MAP(k-1)-MAPDEL$$

$$\text{if } MAP(k)>MAP(k-1)+MAPDEL, \text{ otherwise}$$

$$UMAP(k)=0$$

where MAPDEL is a predetermined constant (gain limit) that differentiates between small and large transient behavior in MAP. If there is small transient behavior in MAP, then UMAP is set to zero. Thus, the components UMAF and UMAP enable accurate calibration of the predictor coefficients during small or large transient behavior.

Figure 2:
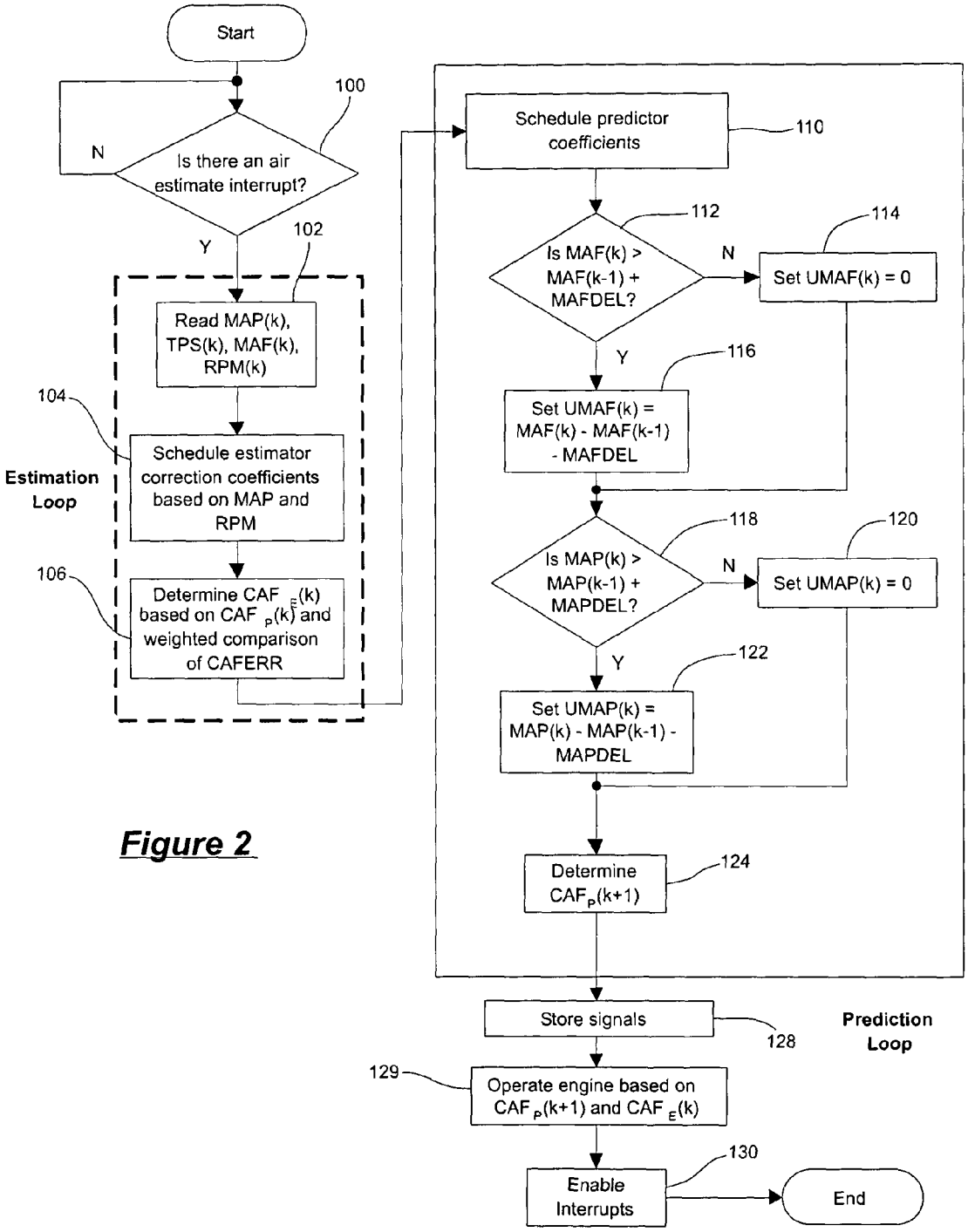
FIG. 2 is a flowchart illustrating steps of a CAF estimation-prediction method according to the present invention.

Referring now to FIG. 2, the estimation-prediction control system will be described. The estimation-prediction control system determines a current $CAF_E$ based on a prior $CAF_P$ during an estimation loop. The engine 12 is operated based on $CAF_P$ and $CAF_E$. A prediction loop determines $CAF_P$ for a future engine event based on the results of current engine operation.

At step 100, control determines whether a CAF estimate interrupt is signaled. If false, control loops back. If true, control continues with step 102 and reads the current engine conditions (i.e. at time k) including TPS, MAP, MAF, and RPM. In step 104, the estimator correction coefficients are determined based on a MAP and RPM schedule, as described above. In step 106, $CAF_E(k)$ (i.e. current) is determined based on $CAF_P(k)$ and a weighted comparison of CAF error (CAFERR). CAFERR is determined based on $CAF_P(k)$ and $CAF_M(k)$ and the estimator correction coefficients.

In step 110, control enters the prediction loop by determining the predictor coefficients. The predictor coefficients are determined based on the schedule zones as described above. In step 112, control determines whether small or large transient behavior is occurring in MAF. If MAF(k) is less than or equal to the sum of MAF(k−1) and MAFDEL, small transient behavior is occurring and control continues with step 114. If MAF(k) is greater than the sum of MAF(k−1) and MAFDEL, large transient behavior is occurring and control continues with step 116. In step 114, UMAF(k) is set equal to zero. In step 116, UMAF(k) is set equal to the difference of MAF(k), MAF(k−1), and MAFDEL.

Control continues with step 118 and determines whether small or large transient behavior is occurring in MAP. If MAP(k) is less than or equal to the sum of MAP(k−1) and MAPDEL, small transient behavior is occurring and control continues with step 120. If MAP(k) is greater than the sum of MAP(k−1) and MAPDEL, large transient behavior is occurring and control continues with step 122. In step 120, UMAP(k) is set equal to zero. In step 122, UMAP(k) is set equal to the difference of MAP(k), MAP(k−1), and MAPDEL.

In steps 124 $CAF_P(k+1)$ is determined. $CAF_P(k+1)$ is used in a future estimation iteration to determine $CAF_E$. Control exits the prediction loop and stores both calculated values and measured values in memory in step 128 for use in a future estimation-prediction iteration. In step 129, control operates the engine 12 based on $CAF_E(k)$ and $CAF_P(k+1)$ as determined in steps 106 and 124, respectively. In step 130, the air estimate interrupt is cleared and control ends.

Those skilled in the art can now appreciate from the foregoing description that the broad teachings of the current invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

The invention claimed is:

1. A vehicle system to predict cylinder air flow (CAF) into engine cylinders, comprising:

a throttle position sensor that generates a current throttle position signal (TPS);

a mass air flow (MAF) sensor that generates a current actual MAF signal;

a manifold absolute pressure (MAP) sensor that generates a current actual MAP signal; and a controller that determines a current estimated CAF signal, determines an MAF transient signal, determines a MAP transient signal, and determines a predicted CAF signal into said engine based on said current estimated CAF signal, said current actual MAF signal, said current MAP signal, said current TPS signal, said MAF transient signal, and said MAP transient signal.

2. The vehicle system of claim 1 wherein said MAF transient signal is based on a pre-defined MAF gain limit.

3. The vehicle system of claim 1 wherein said MAP transient signal is based on a pre-defined MAP gain limit.

4. The vehicle system of claim 1 wherein said MAF transient signal is based on said current actual MAF signal and a prior actual MAF signal.

5. The vehicle system of claim 4 wherein said controller sets said MAF transient signal to zero if said MAF gain limit is less than a difference between said current actual MAF signal and said prior actual MAF signal.

6. The vehicle system of claim 4 wherein said MAF transient signal is based on a difference between said current actual MAF signal, said prior actual MAF signal, and said MAF gain limit if said MAF gain limit is greater than a difference between said current actual MAF signal and said prior actual MAF signal.

7. The vehicle system of claim 1 wherein said MAP transient signal is based on said current actual MAP signal and a prior actual MAP signal.

8. The vehicle system of claim 7 wherein said controller sets said MAP transient signal to zero if said MAP gain limit is less than a difference between said current actual MAP signal and said prior actual MAP signal.

9. The vehicle system of claim 7 wherein said MAP transient signal is based on a difference between said current actual MAP signal, said prior actual MAP signal, and said MAP gain limit if said MAP gain limit is greater than a difference between said current actual MAP signal and said prior actual MAP signal.

10. The vehicle system of claim 1 wherein said controller schedules a select set of model coefficients based on a measured engine parameter and determines said predicted CAF signal based on said select set of model coefficients.

11. The vehicle system of claim 10 wherein said select set of model coefficients is based on engine speed (RPM).

12. The vehicle system of claim 10 wherein said select set of model coefficients is based on MAP.

13. The vehicle system of claim 1 wherein said controller operates said engine based on said current estimated CAF signal.

14. The vehicle system of claim 1 wherein said controller determines said current estimated CAF signal based on a prior predicted CAF signal.

15. A method of operating an engine based on predicted cylinder air flow (CAF), comprising:

determining a current estimated CAF signal into said engine based on a prior predicted CAF signal;

calculating a mass air flow (MAF) transient signal based on a pre-defined MAF gain limit;

calculating a manifold absolute pressure (MAP) transient signal based on a pre-defined MAP gain limit;

generating a current predicted CAF signal into said engine based on said current estimated CAF signal, said MAF transient signal, and said MAP transient signal; and operating said engine based on said current estimated CAF signal and said current predicted CAF signal.

16. The method of claim 15 further comprising:

generating a current actual MAF signal into said engine;

generating a current actual MAP signal of said engine;

sending a current throttle position (TPS) signal; and determining said current predicted CAF signal based on said current actual MAF signal, said current actual MAP signal, and said current TPS signal.

17. The method of claim 16 wherein said MAF transient signal is based on said current actual MAF signal and a prior actual MAF signal.

18. The method of claim 17 further comprising setting said MAF transient signal to zero if said MAF gain limit is less than a difference between said current actual MAF signal and said prior actual MAF signal.

19. The method of claim 17 further comprising setting said MAF transient signal as a difference between said current actual MAF signal, said prior actual MAF signal, and said MAF gain limit if said MAF gain limit is greater than a difference between said current actual MAF signal and said prior actual MAF signal.

20. The method of claim 16 wherein said MAP transient signal is based on said current actual MAP signal and a prior actual MAP signal.

21. The method of claim 20 further comprising setting said MAP transient signal to zero if said MAP gain limit is less than a difference between said current actual MAP signal and said prior actual MAP signal.

22. The method of claim 20 further comprising setting said MAP transient signal as a difference between said current actual MAP signal, said prior actual MAP signal, and said MAP gain limit if said MAP gain limit is greater than a difference between said current actual MAP signal and said prior actual MAP signal.

23. The method of claim 15 further comprising:

scheduling a select set of model coefficients based on a measured engine parameter; and determining said predicted CAF signal based on said select set of model coefficients.

24. The method of claim 23 wherein said select set of model coefficients is based on engine speed.

25. The method of claim 23 wherein said select set of model coefficients is based on MAP.

26. A method of predicting cylinder air flow (CAF) into engine cylinders, comprising:

determining a current estimated CAF signal into said engine;

generating a current actual mass air flow (MAF) signal into said engine;

generating a current actual manifold absolute pressure (MAP) signal of said engine;

sending a current throttle position (TPS) signal;

calculating an MAF transient signal based on a pre-defined MAF gain limit;

calculating an MAP transient signal based on a pre-defined MAP gain limit; and determining a predicted CAF signal into said engine based on said current estimated CAF signal, said current actual MAF signal, said current MAP signal, said current TPS signal, said MAF transient signal, and said MAP transient signal.

27. The method of claim 26 further comprising controlling operation of said engine based on said current estimated CAF signal.

28. The method of claim 26 further comprising determining said current estimated CAF signal based on a prior predicted CAF signal.

29. The method of claim 26 wherein said MAF transient signal is based on said current actual MAF signal and a prior actual MAF signal.

30. The method of claim 29 further comprising setting said MAF transient signal to zero if said MAF gain limit is less than a difference between said current actual MAF signal and said prior actual MAF signal.

31. The method of claim 29 further comprising setting said MAF transient signal as a difference between said current actual MAF signal, said prior actual MAF signal, and said MAF gain limit if said MAF gain limit is greater than a difference between said current actual MAF signal and said prior actual MAF signal.

32. The method of claim 26 wherein said MAP transient signal is based on said current actual MAP signal and a prior actual MAP signal.

33. The method of claim 32 further comprising setting said MAP transient signal to zero if said MAP gain limit is less than a difference between said current actual MAP signal and said prior actual MAP signal.

34. The method of claim 32 further comprising setting said MAP transient signal as a difference between said current actual MAP signal, said prior actual MAP signal, and said MAP gain limit if said MAP gain limit is greater than a difference between said current actual MAP signal and said prior actual MAP signal.

35. The method of claim 26 further comprising:

scheduling a select set of model coefficients based on a measured engine parameter; and determining said predicted CAF signal based on said select set of model coefficients.

36. The method of claim 35 wherein said select set of model coefficients is based on engine speed.

37. The method of claim 35 wherein said select set of model coefficients is based on MAP.

* * * * *